US006652070B2

(12) United States Patent
Aono et al.

(10) Patent No.: US 6,652,070 B2
(45) Date of Patent: Nov. 25, 2003

(54) INK JET RECORDING APPARATUS, INK JET RECORDING HEAD, AND INK JET RECORDING METHOD

(75) Inventors: Kiyomi Aono, Kanagawa (JP); Ken Hosaka, Kanagawa (JP); Kaneji Yamada, Tokyo (JP); Masashi Ogawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/214,107

(22) Filed: Aug. 8, 2002

(65) Prior Publication Data

US 2003/0038861 A1 Feb. 27, 2003

(30) Foreign Application Priority Data

Aug. 10, 2001 (JP) ..... 2001-244220

(51) Int. Cl.[7] ..... B41J 2/14; B41J 2/16; B41J 2/05; B41J 2/19

(52) U.S. Cl. ..... 347/48; 347/60; 347/92

(58) Field of Search ..... 347/9, 14, 48, 347/57, 60, 62, 92, 63, 65, 23, 30, 67

(56) References Cited

U.S. PATENT DOCUMENTS

| | | | | |
|---|---|---|---|---|
| 4,251,824 A | * | 2/1981 | Hara et al. | 347/57 |
| 5,479,196 A | * | 12/1995 | Inada | 347/92 |
| 5,805,180 A | * | 9/1998 | Ebisawa et al. | 347/23 |
| 5,880,762 A | * | 3/1999 | Ishinaga et al. | 347/48 |
| 6,003,973 A | * | 12/1999 | Kamiyama et al. | 347/48 |
| 6,062,678 A | | 5/2000 | Ishinaga et al. | 347/62 |
| 6,224,184 B1 | | 5/2001 | Imanaka et al. | 347/19 |
| 6,293,655 B1 | | 9/2001 | Imanaka et al. | 347/65 |
| 6,302,518 B1 | | 10/2001 | Kudo et al. | 347/42 |
| 6,309,051 B1 | | 10/2001 | Koitabashi et al. | 347/57 |
| 6,325,492 B1 | | 12/2001 | Koitabashi et al. | 347/57 |
| 6,406,137 B1 | | 6/2002 | Okazaki et al. | 347/93 |
| 6,416,155 B1 | | 7/2002 | Takahashi et al. | 347/20 |
| 6,471,321 B1 | | 10/2002 | Aono et al. | 347/14 |

FOREIGN PATENT DOCUMENTS

| | | | | |
|---|---|---|---|---|
| JP | 8-183186 | | 7/1996 | B41J/2/175 |
| JP | 10-16222 | | 1/1998 | B41J/2/05 |
| JP | 401237152 A | * | 3/1998 | B41J/3/04 |

* cited by examiner

*Primary Examiner*—Juanita Stephens
(74) *Attorney, Agent, or Firm*—Fitzpatrick, Cella, Harper & Scinto

(57) ABSTRACT

An jet recording apparatus, which records on a recording medium by discharging ink form a recording head, is provided with at least two electrothermal converting elements each having different amount of heat generation, and driven each individually, which are arranged in the ink flow path communicated with the discharge port of the recording head along the ink flow path each in different distance to the discharge port, and when the pre-discharge is performed without participating in recording, driving signals needed for discharging ink are supplied to the electrothermal converting element on the side near to the discharge port subsequent to being supplied to the electrothermal converting element on the side away from the discharge port. The pre-discharge is performed immediately before recording per line, and the number of discharges is set to be larger for the electrothermal converting element on the side away from the discharge port than the number of discharges for the electrothermal converting element on the side near to the discharge port.

19 Claims, 10 Drawing Sheets

INK JET RECORDING APPARATUS, INK JET RECORDING HEAD, AND INK JET RECORDING METHOD

BACKGROUND OF THE INVENTION

1. Field of the Invention

The present invention relates to an ink jet recording apparatus that records on a recording medium by discharging ink, and also, relates to an ink jet recording head, and an ink jet recording method as well.

2. Related Background Art

A recording apparatus provided with the function of a printer, a copier, a facsimile, and the like, or a recording apparatus used as the output device for a complex type electronic equipment or work station including a computer, a word-processor, and the like, is structured to record images (including characters, symbols, and the like) on a recording medium (recording material) such as paper, cloth, plastic sheet, OHP sheet. A recording apparatus is classified into various types such as ink jet type, wire-dot type, thermal transfer type, and laser beam type, among some others, by the method that the recording apparatus adopts for recording.

In a serial type recording apparatus, which records while conducting the main scan in the direction intersecting with the conveying direction of a recording medium (sheet conveying direction or sub-scanning direction), a recording head serving as recording means, which is mounted on a carriage that travels (conducts main scan) along the recording medium, records images, and after the completion of recording of one-line portion, the sheet is fed for a designated amount (a pitch conveyance as a sub-scanning). Then, after that, images on the next line are recorded (main scanned) on the recording medium that has come to a stop again. Such operation is repeated to execute recording on the recording medium entirely. On the other hand, in a recording apparatus of full-line type that records only by the sub-scanning of a recording medium (recording material) in the conveying direction, the recording medium is set at a designated recording position, and after having executed recording on one-line portion altogether, a sheet feed of a designated amount (pitch conveyance) is conducted, and then, recording on the next line is executed altogether. Such operation is repeated to record on the recording medium entirely.

Of those types of recording apparatus, the ink jet type recording apparatus (ink jet recording apparatus) is the one that records by discharging ink from the ink jet recording head that serves as recording means to a recording medium, and for this type, recording means can be made compact with ease for recording images in high precision at high speed. This type of recording apparatus also has advantages, among some others, that recording is possible on an ordinary paper without giving any particular treatment thereto, and the running cost is made lower, and also, being non-impact type, it has a lesser amount of noises, while it makes easier to record color images using many kinds of ink (color ink, for instance). Also, there have been many demands on the materials of the recording medium (recording material) recordable by the ink jet recording apparatus. In recent years, developments have been made to meet such demands on the recordable materials. Thus, in recent years, in addition to the usual recording medium, such as paper (including thin paper and processed paper), and thin resin sheet (OHP and the like), the recording apparatus has been made capable of using cloth, leather, unwoven textile, and even metal and others as the recording medium therefor.

Particularly, for the ink jet recording apparatus, there have been strong demands in color recording and in high quality recording in recent years. To meet such demands, the apparatus is structured to be able to provide gradational representation by changing dot sizes for obtaining images in high quality. For example, there has been known the structure in which plural electrothermal converting elements (heat generating elements, or heaters) are provided in each inner part of the ink flow paths, which are communicated with the discharge ports of an ink jet recording head, respectively, and then, by the selective supply of electric signals to each of the electrothermal converting elements from a functional element circuit formed on a base plate, the amount of discharge ink per pixel (per discharge port) is changed to make the gradation recording of images possible. As a specific example of the structure of a recording head of the kind, it has been known that in one liquid path (ink flow path), plural electrothermal converting elements (heaters) are arranged in the discharge direction of ink (flow direction), and heaters to be driven or the number of heaters to be driven is selected so as to make the distance different between the discharge port and the heater to be driven in each liquid path (ink flow path), thus changing the discharge amounts of ink.

Also, as another structure, there has been known the one in which plural heaters each having different area are arranged in one liquid path (ink flow path), and by selecting heaters to be driven or the number of heaters to be driven in the same manner so as to change the discharge amounts of ink. Also, it has been generally practiced to execute the so-called pre-discharge, which does not participate in recording directly, in a designated location (at designated sequence) immediately before recording is started, for example, thus preventing defective discharge due to the presence of overly viscose ink in the vicinity of discharge port or in the ink flow path communicated with the discharge port or due to bubbles residing in the ink flow path. Further, as compared with a liquid droplet having large volume (large droplet), a liquid droplet having small volume (small liquid droplet) tends to be encountered with discharge defects immediately after recording is started. Therefore, as disclosed in the specifications of Japanese Patent Laid-Open Application No. 08-183186 and Japanese Patent Laid-Open Application No. 10-016222, when small liquid droplets are discharged for recording, the pre-discharge is executed with large liquid droplets (medium liquid droplets and large liquid droplets) having discharge amount larger than the discharge amount (by small droplets) at that time or to change the time intervals of pre-discharges in order to prevent discharge defects.

However, when a highly precise recording is performed at high speed for various images using an ink jet recording head of discharge amount modulating type in which plural heaters (electrothermal converting elements) are arranged in one ink flow path, there may be encountered some cases where technical problems should be solved as to the pre-discharge (which does not participate in recording directly) executable as one of processing operations in the discharge recovery process described earlier. For example, for recording only characters mainly in black ink, it is required to record thick at high speed, and also, for recording a photographic color images or the like, a highly precise recording is needed. Therefore, it is necessary to execute recording in black by use of large liquid droplets, and recording in colors by use of small liquid droplets. Also, for the small liquid droplets used for color recording, there has been tendency that the discharge amount of ink becomes increasingly smaller in recent years.

Also, it has been desired to highly densify the discharge ports of the recording head and the ink flow paths (liquid paths) communicated therewith for recording images in high precision, and the widthwise dimension of the discharge port is restricted significantly. In order to discharge large droplets in black with the discharge port the widthwise dimension of which is thus restricted, the size (surface area or the like) of the heater (electrothermal converting element) should be made larger or there is a method to make the opening sectional area of the discharge port larger. However, if the heater size is made too large, ink mist (sprayed ink) or the like is generated to invite the degradation of recording quality. Therefore, it is necessary to make the opening sectional area of the discharge port larger. To this end, the liquid path must be made higher than a certain height. On the other hand, when the small color droplets are discharged, the faster the discharge speed, the more precisely becomes the recorded images obtainable. Therefore, the size of the electrothermal converting element cannot be made too small. Under such circumstances, in order to discharge small color droplets, the size of the discharge port (opening sectional area) should be made smaller. Also, the smaller the discharge amount as in the case of small color droplets, the easier it becomes to cause discharge defects due to overly viscous ink in the vicinity of the discharge port or due to bubbles in the liquid path. Therefore, to eliminate such discharge defects, the pre-discharge is carried out by use of liquid droplets larger than the small droplets (medium liquid droplets or large liquid droplets). In this way, the overly viscous ink can be removed to a certain extent.

However, as described earlier, for the prevention of ink mist at the black discharge port, the sectional area of the discharge port is secured to discharge large liquid droplets. Also, the pre-discharges are conducted at the color discharge port with larger liquid droplets (medium liquid droplets or large liquid droplets) in order to eliminate discharge defects due to overly viscous ink or bubbles. As a result, the sectional configuration of the discharge port should be such that the height is larger in relation to the smaller sectional area. Thus, there is formed an excessive space between the discharge port portion on the incident side and the ceiling portion at the leading end of the liquid path, and then, even if the pre-discharge is conducted by use of medium liquid droplets or large liquid droplets, bubbles are not completely exhausted due to the existence of such excessive space, and bubbles remain in the excessive space eventually. Thus, there is a technical problem encountered that despite the execution of pre-discharge, defective recording may take place in some cases. Also, it is difficult to enable the aforesaid remaining bubbles to be completely exhausted by increasing the number of pres-discharges (shooting number of pre-discharges) using medium liquid droplets or large liquid droplets, and there is a probability that only a large amount of ink is wastefully consumed after all.

SUMMARY OF THE INVENTION

It is an object of the preset invention to provide an ink jet recording apparatus, an ink jet head, and an ink jet recording method, which make it possible to perform high-quality recording without causing recording defects, and also, without consuming ink wastefully by completely exhausting foams (bubbles) in the ink flow path by means of pre-discharge.

It is another object of the invention to provide an ink jet recording apparatus, an ink jet head, and an ink jet recording method, which make it possible to perform high-quality recording without causing recording defects, and also, without consuming ink wastefully by completely exhausting foams (bubbles) in the ink flow path by means of pre-discharge even when small liquid droplets are discharged with the ink flow path of the recording head having a large height but small area at the discharge port thereof, for example. It is still another object to provide an jet recording apparatus for recording on a recording medium by discharging ink form a recording head, in which at least two electrothermal converting elements each having different amount of heat generation, and driven each individually, are arranged in the ink flow path communicated with the discharge port of the recording head along the ink flow path each in different distance to the discharge port, and when the pre-discharge is performed without participating in recording, driving signals needed for discharging ink are supplied to the electrothermal converting element on the side near to the discharge port subsequent to being supplied to the electrothermal converting element on the side away from the discharge port.

It is a further object of the invention to provide an ink jet recording head for recording on a recording medium by discharging ink form discharge port, in which at least two electrothermal converting elements each having different amount of heat generation, and driven each individually, are arranged in the ink flow path communicated with the discharge port of the recording head along the ink flow path each in different distance to the discharge port, and when the pre-discharge is performed without participating in recording, driving signals needed for discharging ink are supplied to the electrothermal converting element on the side near to the discharge port subsequent to being supplied to the electrothermal converting element on the side away from the discharge port.

It is still a further object to provide an ink jet recording method for recording on a recording medium by discharging ink from a recording head, which comprises the steps of arranging at least two electrothermal converting elements each having different amount of heat generation, and driven each individually in the ink flow path communicated with the discharge port of the recording head along the ink flow path each in different distance to the discharge port, and supplying driving signals needed for discharging ink to the electrothermal converting element on the side near to the discharge port subsequent to being supplied to the electrothermal converting element on the side away from the discharge port when the pre-discharge is performed without participating in recording.

In accordance with the present invention thus described, foams (bubbles) in the ink flow path can be exhausted by means of the pre-discharge even when small liquid droplets are discharged with the ink flow path having large height but small area at the discharge port thereof, hence providing an ink jet recording apparatus, an ink jet recording head, and an ink jet recording method, which make it possible to perform high-quality recording without causing recording defects, and also, without consuming ink wastefully.

BRIEF DESCRIPTION OF THE DRAWINGS

FIG. 5A shows the case where the ink flow paths are used for colors; and FIG. 5B, the ink flow paths used for black.

DETAILED DESCRIPTION OF THE PREFERRED EMBODIMENTS

Hereinafter, with reference to the accompanying drawings, the specific description will be made of the embodiments in accordance with the present invention. Through each of the accompanying drawings, the same reference marks designate the same parts or corresponding parts.

Figure 1:
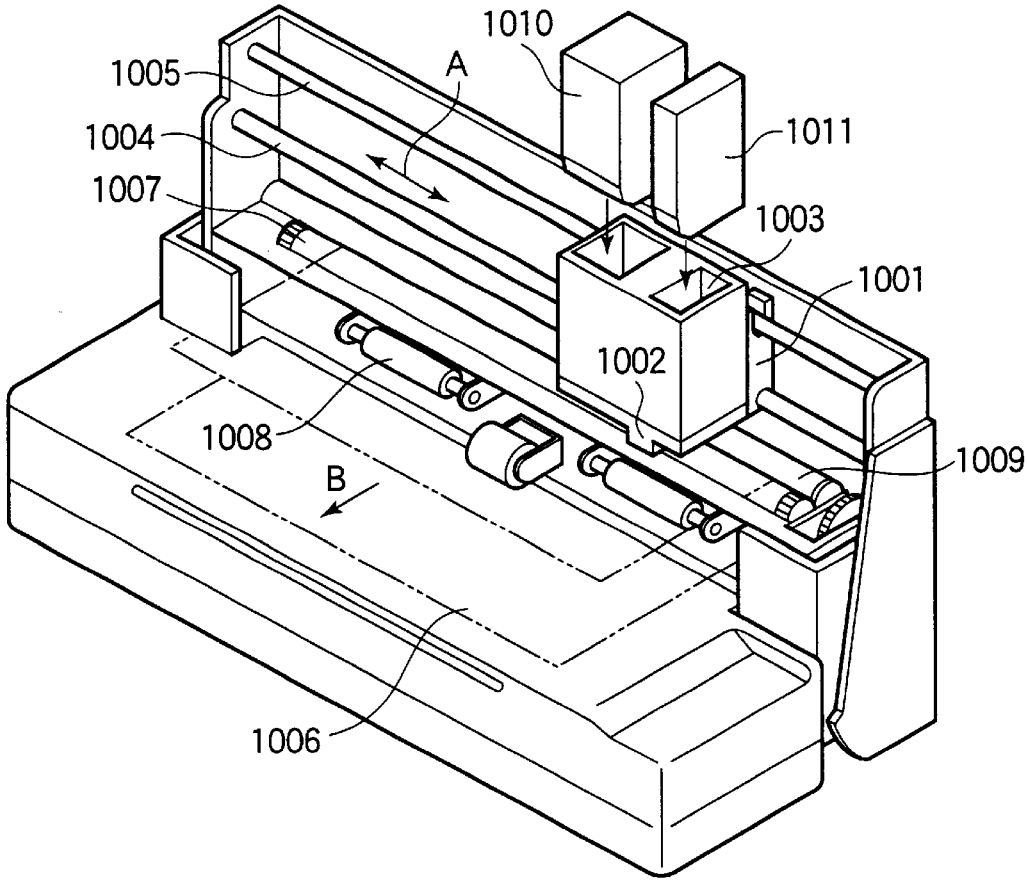
FIG. 1 is a perspective view that schematically shows one embodiment of the ink jet recording apparatus to which the present invention is applicable.

FIG. 1 is a perspective view that schematically shows one embodiment of the ink jet recording apparatus to which the present invention is applicable. In FIG. 1, a carriage 1001 is provided with the lower end portion having an ink jet recording head 1002 fixed thereto; and an ink tank holding portion having an ink tank installed thereon. A color ink tank 1010 to supply ink to the recording head 1002, and a black ink tank 1011 are detachably (exchangeably) mounted along the tank guide 1003, which is formed for the ink tank holding portion.

The carriage 1001 is able to reciprocate in the directions (main scanning directions) indicated by a double-headed arrow A along a lead screw 1004 and the guide shaft 1005, which is installed in parallel thereto, by the rotation of the lead screw 1004 interlocked with a carriage motor (not shown). The ink jet recording head 1002 is provided with the discharge port surface, which faces a recording sheet 1006 serving as a recording medium. From the plural discharge ports formed for the discharge port surface in a designated arrangement, ink is discharged for recording. In other words, an image formation (recording) is effectuated by enabling ink (ink droplets) discharged selectively form plural discharge ports formed on the discharge port surface of the recording head 1002 to be impacted on the recording sheet 1006.

When recording is performed, ink is discharged in synchronism with the traveling (main scanning) of the carriage 1001 (recording head 1002) in accordance with recording data for recording on the recording sheet 1006, and when one-line portion of recording is completed, recording is suspended. During such period, a conveying roller 1007 is driven to feed (convey) the recording sheet 1006 to the position of the next line in the direction indicated by an arrow B. Subsequently, the carriage 1001 is driven again to move the recording head 1002 for the recording of the next line. With repetition of such one-line recording and one-line sheet feeding, recording is performed on the recording sheet 1006 entirely. The recording sheet 1006 after completion of recording is expelled by means of a sheet-expelling roller 1008. In this respect, the recording sheet 1006, which is conveyed through the recording portion of the apparatus main body, is held by use of a sheet pressure plate 1009 within a designated range of gap with the discharge port surface of the recording head 1002.

Figure 2:
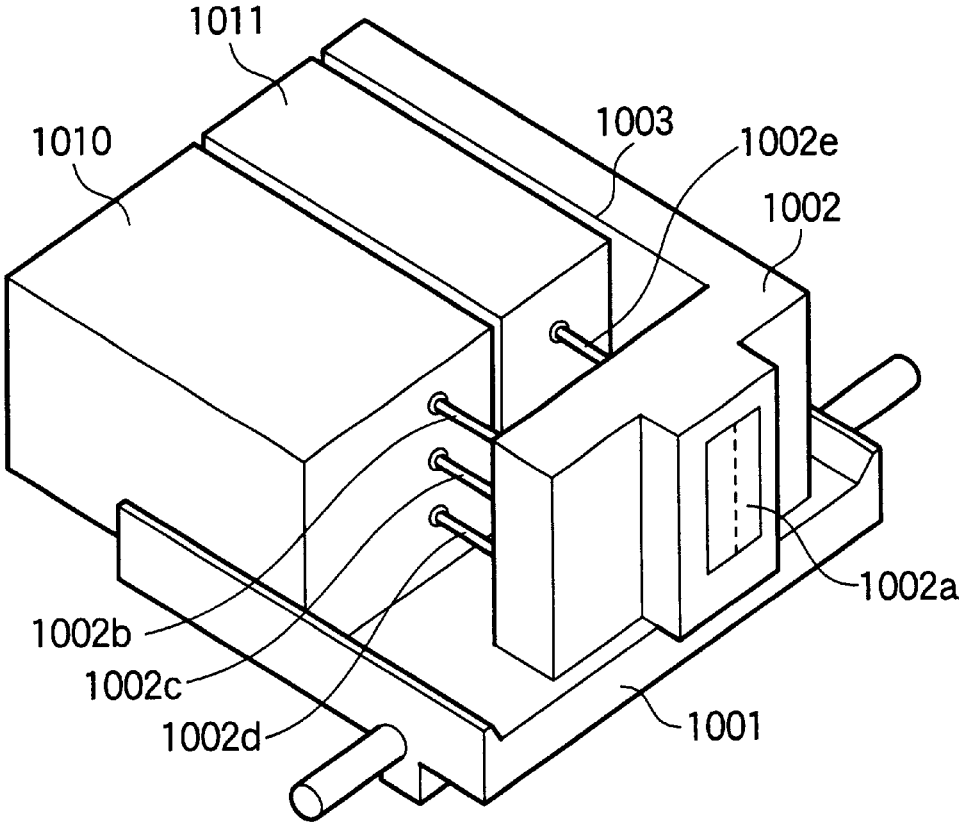
FIG. 2 is a perspective view that schematically shows the structure of the ink jet recording head and ink tank mounted on a carriage in FIG. 1.

FIG. 2 is a perspective view that schematically shows the structure of the ink jet recording head 1002 and ink tanks 1010 and 1011 mounted on the carriage 1001 in FIG. 1. Here, in FIG. 2, it is assumed that the recording head 1002 on the discharge port surface 1002*a* side (the lower face side or bottom face side in the assembly shown in FIG. 1) is on the front, and the side opposite thereto (the upper face side or top end side in the assembly shown in FIG. 1) is on the rear. As shown in FIG. 2, the color ink tank 1010, as well as the black ink tank 1011, is installed from the rear side of the recording head 1002 (tank guide 1003) fixed to the carriage 1001. The color ink tank 1010 is provided with each of ink containing portions of cyan, magenta, and yellow in one housing, respectively. Here, ink is each separated (divided) by use of partition walls. Also, the black ink tank 1011 is connected with the recording head 1002 through an ink supply tube 1002*a*, and the color ink tank 1010 is connected with the recording head 1002 through three ink supply tubes 1002*b*, 1002*c*, and 1002*d* corresponding to each color ink, respectively.

Figure 3:
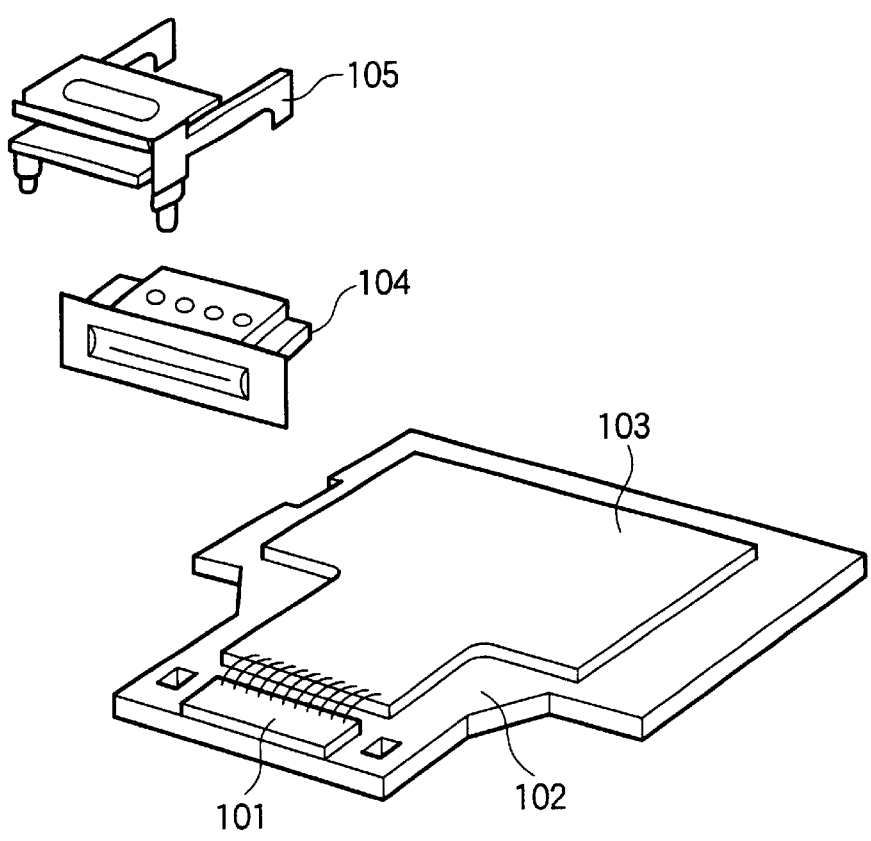
FIG. 3 is an exploded perspective view that schematically shows the structure of one embodiment of the ink jet recording apparatus to which the present invention is applicable.

FIG. 3 is an exploded perspective view that schematically shows the structure of one embodiment of the ink jet recording head 1002 to which the present invention is applicable. In FIG. 3, an ink jet recording apparatus is assembled in such a manner that on the base plate 102, on which an element base plate 101 and a wring plate (control means) 103 are installed, a grooved ceiling plate 104 is laminated, and fixed by use of a fixing member 105. For the element base plate 101, heat generating elements (discharge energy generating means=heaters) serving as plural electrothermal converting elements are provided. The ink jet recording head 1002 that services as recording means as described earlier is the ink jet recording means that discharge ink utilizing thermal energy, which is provided with electrothermal converting element (heater) for generating thermal energy. Also, the recording head 1002 generates film boiling in ink by means of thermal energy given by the electrothermal converting element. Then, by the utilization of pressure exerted by the growth and shrinkage of bubble generated then, ink is discharged for recording (printing).

The discharge port surface 1002*a* of the recording head 1002 is arranged to face a recording medium 1006, such as recording sheet, with a designated gap (approximately 0.2 mm to approximately 2.0 mm, for instance). The recording head 1002 is mounted on a carriage 1001 with the positional relations that the discharge port array formed on the discharge port surface 1002*a* is lined in the direction intersecting with the main scanning direction (traveling direction of the head and carriage). Then, the corresponding electrothermal converting element is driven (energized) in accordance with image signals or discharge signals to generate film boiling in ink in the ink flow path (liquid path). In this way, the recording head 1002 is structured so that ink is discharge from the discharge port by the pressure, which is thus generated at that time.

Figure 4:
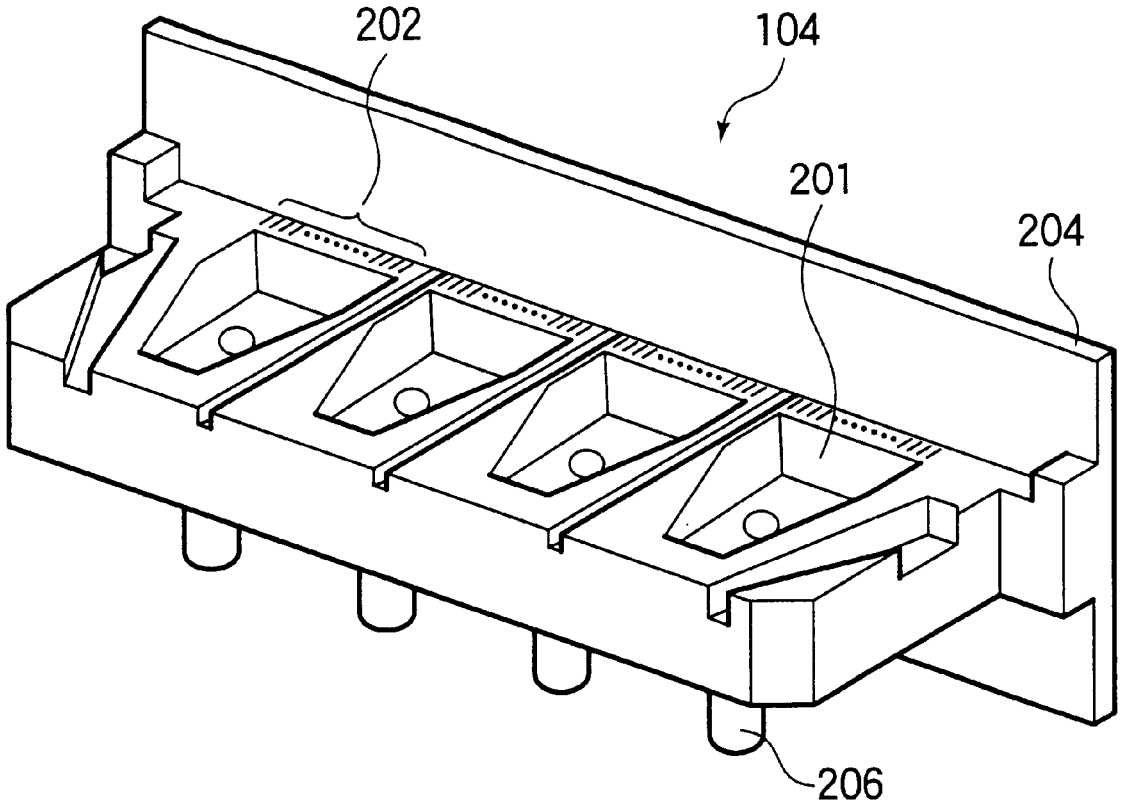
FIG. 4 is an enlarged perspective view that schematically shows the structure of a ceiling plate provided with grooves in FIG. 3.

FIG. 4 is an enlarged perspective view that shows the structure of the grooved ceiling plate 104 in FIG. 3. In FIG. 4, four common liquid chambers 201 serving as sub-tanks are formed for the grooved ceiling plate 104 corresponding to the respective ink colors (black, cyan, magenta, and yellow). With each of the common liquid chambers 201, an ink supply tube 206 is communicated. To the front part (the lower face in the assembled condition shown in FIG. 1) of the grooved ceiling plate 104, an orifice plate 204 is fixed with the aforesaid discharge port surface 1002*a*. On the discharge port surface 1002*a* of the orifice plate 204, the black discharge port array, cyan discharge port array, magenta discharge port array, and yellow discharge port array are arranged vertically in one line as shown in FIG. 2, FIG. 3, and FIG. 4. Then, each of the common liquid chambers 201 and the discharge port of each discharge port array of the orifice plate 204 are communicated by means of the ink flow path 202. Inside each of the ink flow paths 202, there are arranged plural electrothermal converting elements (heaters), each having different area, in the different positions in the direction of ink flow (vertical direction).

Figure 5A:
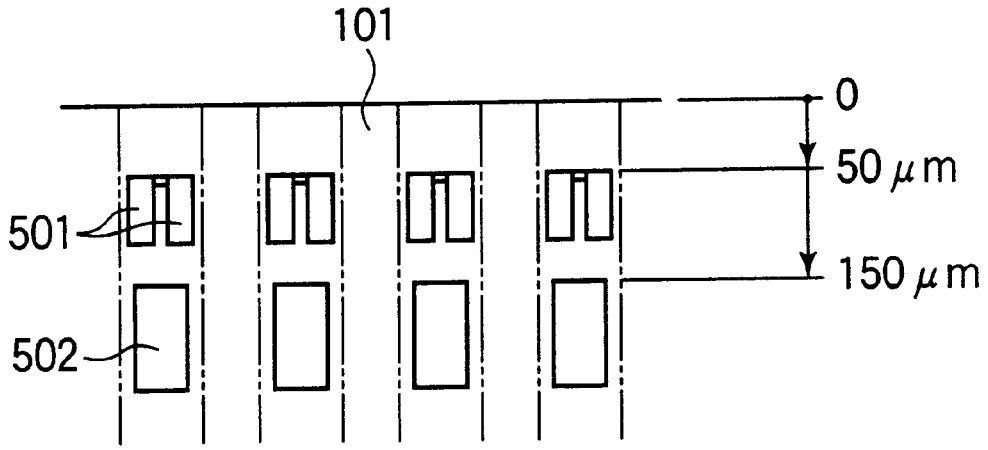
FIGS. 5A and 5B are views that illustrate schematically the arrangement condition of plural electrothermal converting elements in each of the flow paths in FIG. 4.
Figure 5B:
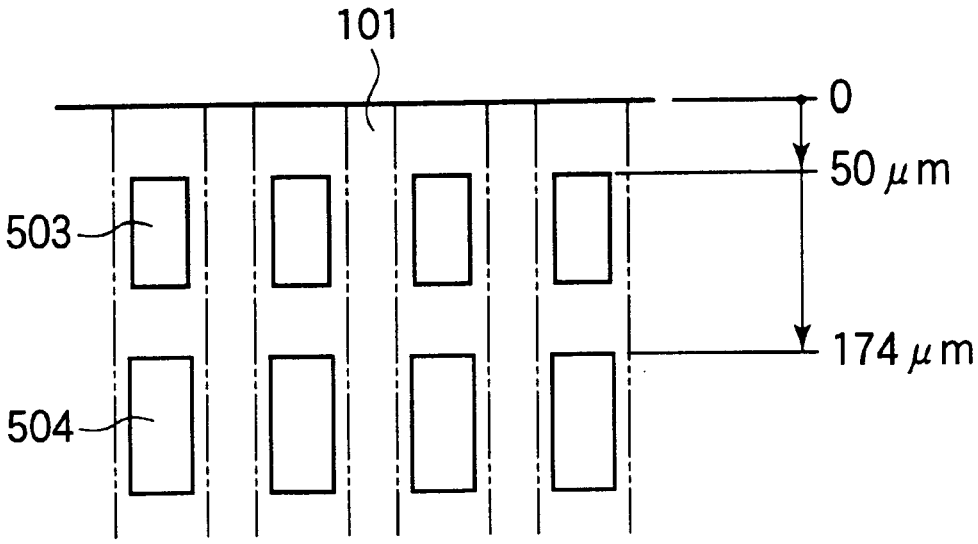

FIGS. 5A and 5B are views that schematically illustrate the arrangement conditions of plural electrothermal converting elements (heaters) in each ink flow path 202 in FIG. 4; FIG. 5A shows the case of ink flow paths for use of color ink; and FIG. 5B shows the case of ink flow paths for use of black ink. In FIGS. 5A and 5B, there are arranged plural heat generating elements (electrothermal converting elements, discharge energy generating means, heaters) on the element base plate 101, and inside the ink flow path (one ink flow path) 202, plural (two) heaters each having different size, which can be driven individually, are arranged vertically in line so as to make the distance from the discharge port to the heater different. FIG. 5A shows one example of heater arrangement condition in the ink flow path for use of color ink. FIG. 5B shows one example of heater arrangement condition in the ink flow path for use of black ink.

An ink jet recording head shown in FIG. 5A and FIG. 5B is provided with plural discharge ports arranged to discharge ink droplets; plural ink flow paths communicated with each of the discharge ports; plural supply ports for supplying ink to each of the ink flow paths, respectively; and at least two heat generating elements arranged for one ink flow path. For the ink jet recording apparatus of the present embodiment, ink of four colors, yellow, magenta, cyan, and black, are used as recording ink. For the application hereof, yellow ink, magenta ink, and cyan ink are called collectively as color ink. Also, for the present embodiment, there are arranged in one ink flow path two heaters, each of which can be driven individually and separately, and then, three discharge amount modes, small, medium, and large, that is, the three discharge amount modes of small liquid droplets, medium liquid droplets, and large liquid droplets, are made available by the combination of heaters to be driven (fundamentally, by switching the heaters to be driven).

In the small droplet mode, only the front heaters (heaters on the discharge port side) 501 in FIG. 5A are driven. In the medium droplet mode, only the rear heater (heater on the side away from the discharge port) 502 in FIG. 5A is driven. In the large droplet mode, the front heater (heater on the discharge port side) 503 and the rear heater (heater on the side away from the discharge port) 504 in FIG. 5B are driven simultaneously or with timing gap. In this respect, for the recording head 1002 of the present embodiment, the distance from the front edge of the element base plate 101 to the front heater 501 is selected to be 50 $\mu$m, and the distance from the front edge of the element base plate 101 to the rear heater 502 is 150 $\mu$m in the color ink flow path, and in the in the black ink flow path, the distance from the front edge of the element base plate 101 to the front heater 503 is selected to be 50 $\mu$m, and the distance from the front edge of the element base plate 101 to the rear heater 504 is 174 $\mu$m as shown in FIG. 5A and FIG. 5B, respectively.

Figure 6:
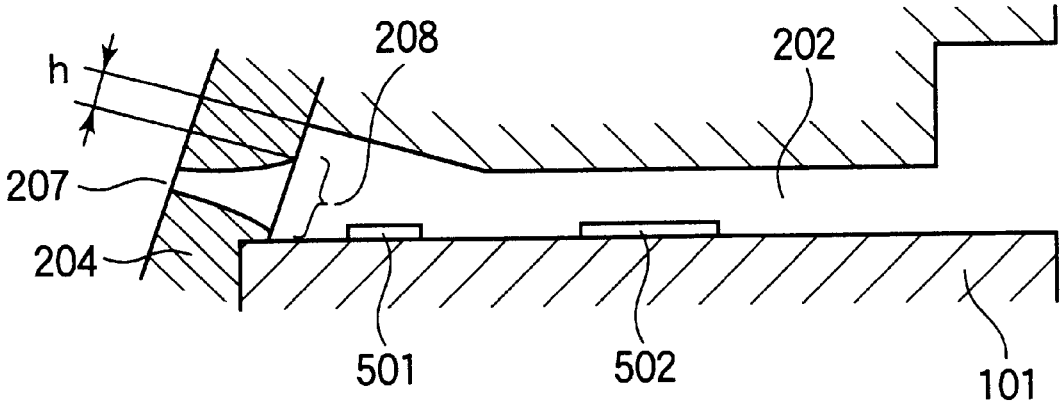
FIG. 6 is a vertically sectional view that schematically shows the color ink flow path of an ink jet recording head in accordance with one embodiment, to which the present invention is applicable.
Figure 7:
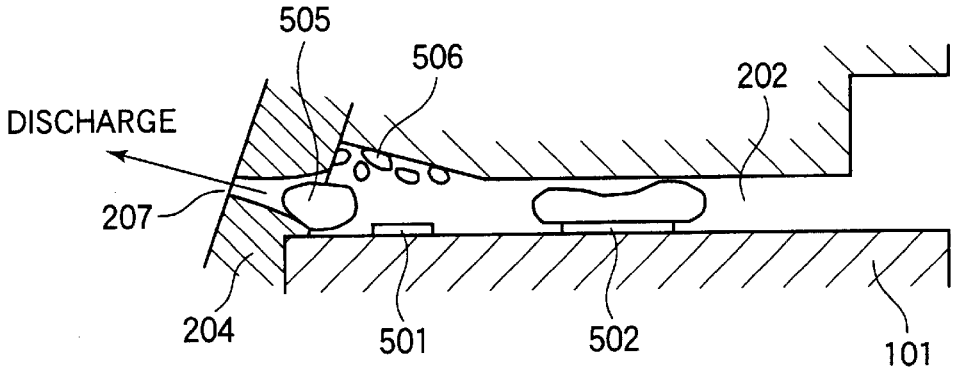
FIG. 7 is a vertically sectional view that schematically shows a state where the pre-discharge is performed in a discharge amount mode of medium liquid droplets in the color ink flow path in FIG. 6 as an example.
Figure 8:
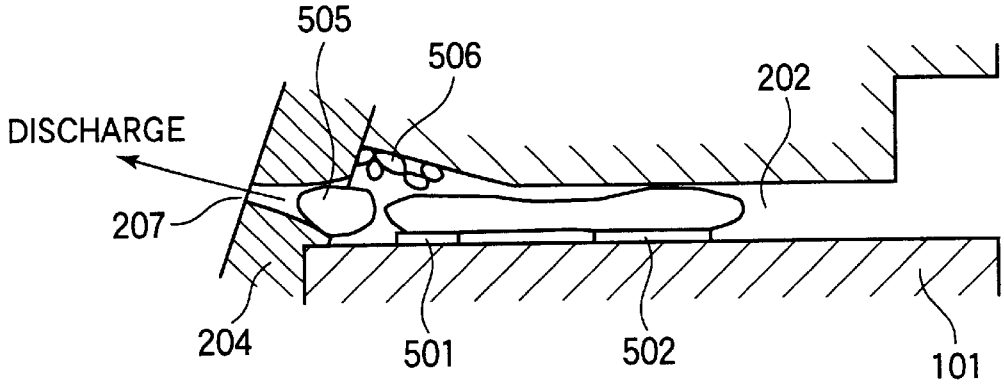
FIG. 8 is a vertically sectional view that schematically shows a state where the pre-discharge is performed in a discharge amount mode of large liquid droplets in the color ink flow path in FIG. 6 by driving the front heater and the rear heater simultaneously or with timing gap as an example.
Figure 9:
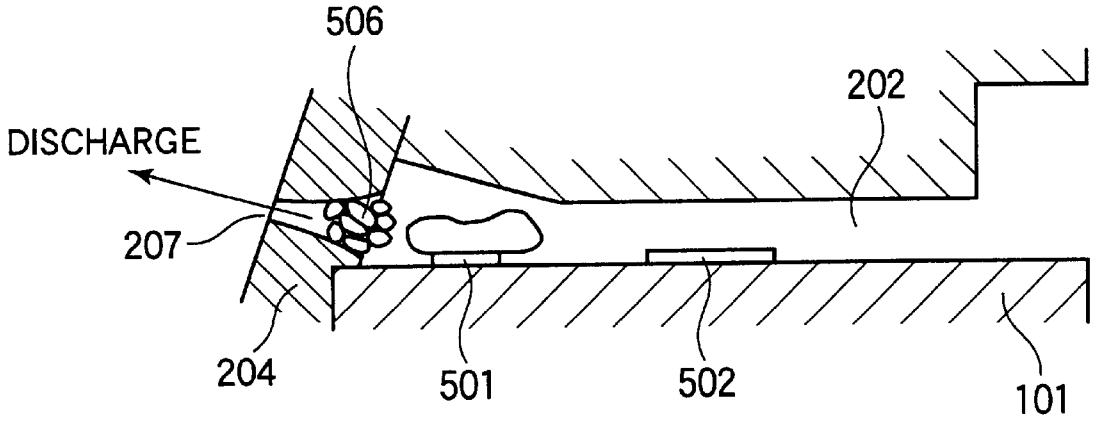
FIG. 9 is a vertically sectional view that schematically shows a state where the front heater is driven for the pre-discharge in a discharge amount mode of small liquid droplets in the color ink flow path in FIG. 6.
Figure 10:
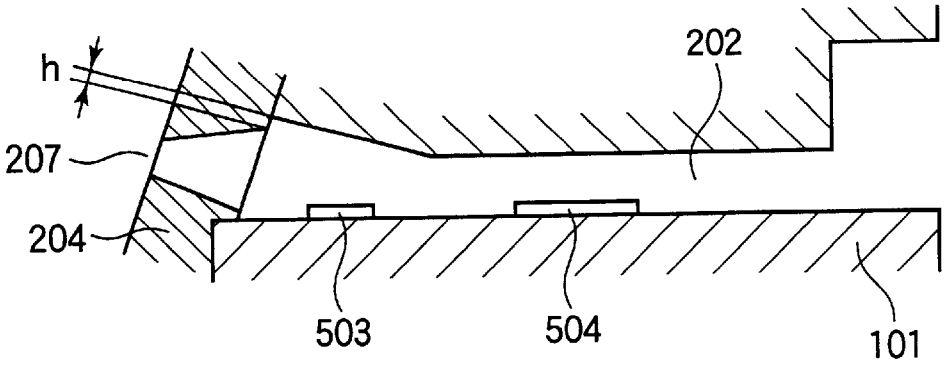
FIG. 10 is a vertically sectional view that schematically shows one embodiment of a black ink flow path of an ink jet recording head, to which the present invention is applicable.

In accordance with the present embodiment, the discharge port for color ink, in particular, discharges small liquid droplets for recording in the discharge amount mode of small liquid droplets, and discharges medium liquid droplets for the execution of pre-discharges, and then, subsequently, small liquid droplets are discharged in the discharge amount mode of small liquid droplets. FIG. 6 is a vertically sectional view that schematically shows the color ink flow path (one ink flow path) of an ink jet recording head in accordance with one embodiment, to which the present invention is applicable. FIG. 7 is a vertically sectional view that schematically shows a state where the pre-discharge is performed in a discharge amount mode of medium liquid droplets in the color ink flow path in FIG. 6 as an example. FIG. 8 is a vertically sectional view that schematically shows a state where the pre-discharge is performed in a discharge amount mode of large liquid droplets in the color ink flow path in FIG. 6 by driving the front heater and the rear heater simultaneously or with timing gap as an example. FIG. 9 is a vertically sectional view that schematically shows a state where the front heater is driven for the pre-discharge in a discharge amount mode of small liquid droplets in the color ink flow path in FIG. 6. FIG. 10 is a vertically sectional view that schematically shows one embodiment of a black ink flow path (one ink flow path) of an ink jet recording head, to which the present invention is applicable.

Next, with reference to FIG. 6 to FIG. 9, the description will be made of the case where the pre-discharge is performed by use of the recording head to which the present invention is applicable, while making comparison with the conventional example. In FIG. 6, since the gap h between the ceiling portion at the leading end of the ink flow path 202 and the discharge port 208 on the incident side is large, the flow rate becomes slow in this portion against the ink flow from the rear, and the slower the flow rate, the more stagnation occurs. As a result, it becomes necessary to remove the large foam (bubble) 505 that cannot be removed completely by suction recovery and remains in the ink flow path 202, and small foams (bubbles) 506, which are generated when discharging small liquid droplets for recording. Here, when the pre-discharge is performed in the discharge amount mode of medium liquid droplets as has been effectuated conventionally, the large bubble 505 can be exhausted from the discharge port 207 as shown in FIG. 7, but the small bubbles 506 accumulated in the stagnated portion still remain intact. If small droplets are discharged in this condition, defective discharge occurs due to such bubbles, hence resulting in defective recording. Here, in accordance with the present embodiment, the area of the discharge port is 175 $\mu m^2$ for the color discharge port, and 310 $\mu m^2$ for the black discharge port.

Also, when the pre-discharge is performed by the front heater 501 and the rear heater 502 simultaneously or timing gap in the conventional discharge amount mode of large liquid droplets, bubbles are made large as shown in FIG. 8, and to the extent that the liquid droplet becomes larger, the flow rate of ink is made slower in the ink flow path 202, thus making it impossible to exhaust bubbles in the stagnated portion. Also, when the pre-discharge is performed by driving only the front heater 501 in the discharge amount mode of small liquid droplets, the amount of overly viscous ink and bubbles exhausted from the recording head 1002 is reduced, and particularly, the large foam (bubble) 505 residing in the rear side of the ink flow path 202 is difficult to be exhausted. Thus, for the pre-discharge by the ink jet recording head 1002 to which the present invention is applicable, the pre-discharge is performed in the discharge amount mode of medium liquid droplets at first as described earlier so as to exhaust the large bubble 505 from the discharge port 207 as shown in FIG. 7, and to collect small bubbles 506 in the front part of the ink flow path 202.

Then, as shown in FIG. 9, the front heater 501 is driven in the discharge amount mode of small liquid droplets to perform the pre-discharge, hence exhausting small bubbles 506 on the front part of the ink flow path 202. This is because there is stagnated portion immediately above the front heater 501, and small bubbles reside in this portion, and when the front heater 501 is driven for bubbling, the pressure waves thereof are directly propagated to the portion where small bubbles 506 reside, hence generating ink flow, and then, with this ink flow, small bubbles are exhausted. In this way, with the pre-discharge in the discharge amount mode of small liquid droplets following the pre-discharge in the discharge amount mode of medium liquid droplets, foams (bubbles) in the ink flow path 202 are all exhausted, and thereafter, when recording is performed even in the discharge amount of mode of small liquid droplets, defective discharge due to the existence of the aforesaid bubbles or overly viscous substance does not take place to make high quality recording possible. Also, the amount of ink consumption can be minimized.

Next, the description will be made of the case where the aforesaid pre-discharge of the present embodiment is adopted for the pre-discharge process, which is performed immediately before recording for every line (immediately before recording per one line), at the time of recording (particularly for color recording). In accordance with the present embodiment, the ink jet recording head 1002 drives only the front heater 501 when color recording is performed that often uses small liquid droplets. Therefore, the accumulation of bubbles is gradually increased in the rear of the ink flow path 202, leading to the discharge defects caused by the accumulation of such bubbles. Also, all the ink flow paths are not necessarily used for recording at all the time. In the ink flow path, which is not used for a long time, overly viscous ink or solidified ink is generated, which may cause recording defects.

Therefore, in accordance with the present embodiment, immediately before recording is performed every line (immediately before recording per line) the pre-discharge is executed as given below. In other words, 40 shots of pre-discharges are performed at first in the discharge amount mode of medium liquid droplets. Subsequently, then, 30 shots of pre-discharges are performed in the discharge amount mode of small liquid droplets. In this case, the driving frequency is 2 KHz for both of them. In such pre-discharge condition as this, comparatively large bubble in the ink flow path is exhausted, and overly viscous ink in the vicinity of the discharge port is removed in the discharge amount mode of medium liquid droplets, and foams (bubbles) reside in the stagnated portion at the leading end of the ink flow path can be exhausted. Here, the shooting number (discharge number) for the discharge amount mode of medium liquid droplets is changed experimentally, with the result that with 40 shots or more, excellent effect is demonstrated in the exhaustion of large bubble and removal of overly viscous ink. Also, the shooting number (discharge number) in the discharge amount mode of small liquid droplets is changed for experiments, with the result that with 30 shots or more, excellent effect is demonstrated in exhausting bubbles residing immediately above the front heater 501.

In this manner, with more shot numbers of the discharge amount mode of medium liquid droplets than those of the discharge amount mode of small liquid droplets, it becomes possible to prevent recording defects from being created due to the existence of overly viscous ink or foams (bubbles) for the execution of high quality recording. Also, the shot number (discharge number) in the discharge amount mode of small liquid droplets and the shot number (discharge number) in the discharge amount mode of medium liquid droplets can be increased or decreased depending on the kinds of ink, the configuration of ink flow path, the discharge port area (the area of opening), and the like.

For the embodiment described above (the first embodiment), the ink jet recording apparatus that records on a recording medium by discharging ink from the recording head, and the ink jet recording method adopted therefor are structured in such a manner that in each of the ink flow paths communicated with each of the discharge ports of the recording head, at least two electrothermal converting elements, which can be driven each individually, and generate different amounts of heat, respectively, are arranged each in different distance to the discharge port, and when the pre-discharge, which does not directly participate in recording, is performed, the driving signals needed for discharging ink are supplied to the electrothermal converting element positioned near the discharge port subsequent to having supplied the signals to the electrothermal converting element positioned away from the discharge port. Further, this pre-discharge is the one performed immediately before recording per recording of one line, and the structure is arranged so that the discharge numbers of the electrothermal converting elements 502 and 504 on the side away from the discharge port 207 is more than the discharge numbers of the electro-converting elements 501 and 503 on the side near to the discharge port 207. With the structure thus arranged, it is possible to provide the ink jet recording apparatus, ink jet recording head, and ink jet recording method, which make it possible to record in high quality without creating recording defects, and also, without consuming a large amount of ink, by exhausting foams (bubbles) in the ink flow path completely by the execution of pre-discharge when small liquid droplets are discharged from the recording head 1002, the discharge port 207 of which has a small area, although the height of the ink flow path 202 thereof is large.

Next, the description will be made of the case (a second embodiment) where the pre-discharge operation of the present invention is applied to the pre-discharge operation to be executed per a designated number of discharges of ink discharges or the like for recording. In this respect, when the pre-discharge is executed per a designated number of discharges for recording, the discharge numbers are counted by use of a discharge number counter, and the pre-discharge operation is controlled on the basis of the counted value thus obtained. As described in the first embodiment, if the ink jet recording head 1002 mounted on a recording apparatus is left intact with ink being filled therein, or when the ink flow path (discharge port) is not used during recording operation, ink in the vicinity of the discharge port becomes overly viscous to cause recording defects.

Further, if the ink flow path (discharge port) is left intact for a long time without being used in a state where foams (bubbles) generated at the time of ink discharges still remain therein, the foams (bubbles) are allowed to grow by the temperature rise in the recording head during recording, and discharge defects may occur in some cases. In order to eliminate such cause of recording defects, a method for processing pre-discharges is adopted such as to count the number of discharges (shot number of discharges) and to execute the pre-discharge at a designated timing (intervals, subsequent to a designated number of discharge), while predicting the foaming (bubbling) condition that may be created particularly when ink is discharged.

Here, in accordance with the present embodiment (the second embodiment), the pre-discharge subsequent to a designated number of discharges is executed in the condition given below. In other words, 40 shots of pre-discharges are performed at first in the discharge amount mode of medium liquid droplets. Subsequently, then, 30 shots of pre-discharges are performed in the discharge amount mode of small liquid droplets. In this case, the driving frequency is 2 KHz for both of them. In such pre-discharge condition as this, comparatively large bubble in the ink flow path is exhausted, and overly viscous ink in the vicinity of the discharge port is removed in the discharge amount mode of medium liquid droplets, and foams (bubbles) reside in the stagnated portion at the leading end of the ink flow path can be exhausted. Here, the shooting number (discharge number) for the discharge amount mode of medium liquid droplets is changed experimentally, with the result that with 40 shots or more, excellent effect is demonstrated in the exhaustion of large bubble and removal of overly viscous ink. Also, the shooting number (discharge number) in the discharge amount mode of small liquid droplets is changed for experiments, with the result that with 30 shots or more, excellent effect is demonstrated in exhausting bubbles residing immediately above the front heater 501.

In this manner, with more shot numbers of the discharge amount mode of medium liquid droplets than those of the discharge amount mode of small liquid droplets, it becomes possible to prevent recording defects from being created due to the existence of overly viscous ink or foams (bubbles) for the execution of high quality recording. Also, the shot number (discharge number) in the discharge amount mode of small liquid droplets and the shot number (discharge number) in the discharge amount mode of medium liquid droplets can be increased or decreased depending on the kinds of ink, the configuration of ink flow path, the discharge port area (the area of opening), and the like.

For the embodiment described above (the second embodiment), the ink jet recording apparatus that records on a recording medium by discharging ink from the recording head, and the ink jet recording method adopted therefor are structured in such a manner that in each of the ink flow paths communicated with each of the discharge ports of the recording head, at least two electrothermal converting elements, which can be driven each individually, and generate different amounts of heat, respectively, are arranged each in different distance to the discharge port, and when the pre-discharge, which does not directly participate in recording, is performed, the driving signals needed for discharging ink are supplied to the electrothermal converting element positioned near the discharge port subsequent to having supplied the signals to the electrothermal converting element positioned away from the discharge port. Further, this pre-discharge is the one performed per a designated number of discharges, and the structure is arranged so that the discharge numbers of the electrothermal converting elements 502 and 504 on the side away from the discharge port 207 is more than the discharge numbers of the electrothermal converting elements 501 and 503 on the side near to the discharge port 207. With the structure thus arranged, it is possible to provide the ink jet recording apparatus, ink jet recording head, and ink jet recording method, which make it possible to record in high quality without creating recording defects, and also, without consuming a large amount of ink, by exhausting foams (bubbles) in the ink flow path completely by the execution of pre-discharge when small liquid droplets are discharged from the recording head 1002, the discharge port 207 of which has a small area, although the height of the ink flow path 202 thereof is large.

Next, the description will be made of the case (a third embodiment) where the pre-discharge operation of the present invention is applied to the pre-discharge conducted immediately after the suction recovery operation, which is executed to maintain and recover the ink discharge performance. In this respect, after the suction recovery operation, ink sucked from the discharge port of each color may be mixed with each other in the cap. Then, part of such mixed ink (ink of mixed colors) created by this mixture is allowed to inversely flow into the discharge port, which is mixed with ink in the ink flow path or the common liquid chamber, resulting in the degradation of recording quality in the earlier stage after recording is started. Usually, in order to eliminate the mixed colors of ink of the kind, it is arranged to exhaust the ink of mixed colors existing in the ink flow path or the like by the execution of pre-discharge immediately after the suction recovery operation. The purpose of the pre-discharge then is not only to eliminate the aforesaid ink of mixed colors, but also, to perform the processing operation to exhaust foams (bubbles) in the ink flow path, which cannot be removed completely by the aforesaid suction recovery operation.

Here, in accordance with the present embodiment (the third embodiment), the pre-discharge, which is performed immediately after the suction recovery operation, is executed in the condition given below. In other words, 200 shots of pre-discharges are performed at first in the discharge amount mode of medium liquid droplets. Subsequently, then, 400 shots of pre-discharges are performed in the discharge amount mode of small liquid droplets. In this case, the driving frequency is 2 KHz for both of them. In such pre-discharge condition as this, ink of mixed colors existing in the ink flow path or the like, as well as comparatively large bubble in the ink flow path is exhausted in the discharge amount mode of medium liquid droplets, and also, foams (bubbles) reside in the stagnated portion at the leading end of the ink flow path can be exhausted. Here, the shooting number (discharge number) for the discharge amount mode of medium liquid droplets is changed experimentally, with the result that with 200 shots or more, excellent effect is demonstrated in the exhaustion of large bubble and removal of overly viscous ink. Also, the shooting number (discharge number) in the discharge amount mode of small liquid droplets is changed for experiments, with the result that with 400 shots or more, excellent effect is demonstrated in exhausting bubbles residing immediately above the front heater 501.

Unlike each of the previous embodiments (the first and second embodiments), the present embodiment (the third embodiment) is arranged to set the shooting numbers (discharging numbers) in the discharge amount mode of small liquid droplets larger than those in the discharge amount mode of medium liquid droplets for the reasons that the amount of small foams (bubbles) in the ink flow path, which cannot be removed by the suction recovery operation, is larger than the amount of small bubbles generated during recording, and that when such small bubbles are caused to get together in the stagnated portion at the leading end of the ink flow path, there is a need for more shot numbers for exhausting such small bubbles in the discharge amount mode of small liquid droplets than the shot numbers needed for the pre-discharge performed immediately after the suction recovery operation in the discharge amount mode of medium liquid droplets. In this manner, with more shot numbers of the discharge amount mode of small liquid droplets than those of the discharge amount mode of medium liquid droplets, it becomes possible to prevent recording defects from being created due to the existence of ink of mixed colors and foams (bubbles), hence making it possible to maintain high quality recording. Also, for the present embodiment, the shot number (discharge number) in the discharge amount mode of small liquid droplets and the shot number (discharge number) in the discharge amount mode of medium liquid droplets can be increased or decreased depending on the kinds of ink, the configuration of ink flow path, the discharge port area (the area of opening), and the like.

For the embodiment described above (the third embodiment), the ink jet recording apparatus that records on a recording medium by discharging ink from the recording head, and the ink jet recording method adopted therefor are structured in such a manner that in each of the ink flow paths communicated with each of the discharge ports of the recording head, at least two electrothermal converting elements, which can be driven each individually, and generate different amounts of heat, respectively, are arranged each in different distance to the discharge port, and when the pre-discharge, which does not directly participate in recording, is performed, the driving signals needed for discharging ink are supplied to the electrothermal converting element positioned near the discharge port subsequent to having supplied the signals to the electrothermal converting element positioned away from the discharge port. Further, this pre-discharge is the one performed immediately after the suction recovery operation, and the structure is arranged so that the discharge numbers of the electrothermal converting elements 501 and 503 on the side near to the discharge port 207 is more than the discharge numbers of the electrothermal converting elements 502 and 504 on the side away from the discharge port 207. With the structure thus arranged, it is possible to provide the ink jet recording apparatus, ink jet recording head, and ink jet recording method, which make it possible to record in high quality without creating recording defects, and also, without consuming a large amount of ink, by exhausting foams (bubbles) in the ink flow path completely by the execution of pre-discharge when small liquid droplets are discharged from the recording head 1002, the discharge port 207 of which has a small area, although the height of the ink flow path 202 thereof is large.

In this respect, the description has been made of the aforesaid embodiments by exemplifying the ink jet recording apparatus of serial type that records by enabling the ink jet recording head serving as recording means to travel in the main scanning directions. The present invention is also equally applicable to the ink jet recording apparatus of line type in which recoding is performed only by sub-scanning by use of the ink jet recording head of line type that covers partly or totally the entire width of a recording medium. Also, the present invention is equally applicable to an ink jet recording apparatus that performs monochromatic recording, a color ink jet recording apparatus that records in plural and different colors using a single recording head or plural recording heads, and an ink jet recording apparatus for use of gradational recording that records in one and the same color but in plural and different densities, as well as to an ink jet recording apparatus or the like having these apparatuses combined therefor, with the same effect being attainable.

Also, the present invention is equally applicable to the structure whereby to use an exchangeable cartridge having a recording head and an ink tank integrally formed therefor, the structure whereby to form a recording head and an ink tank as separated members, which are connected by an ink tube or the like for use of ink supply, or to any other structural arrangement of a recording head and an ink tank, with the same effect being attainable.

What is claimed is:

1. An ink jet recording apparatus for recording on a recording medium by discharging ink from a recording head, wherein at least two electrothermal converting elements each having different amount of heat generation, and driven each individually, are arranged in an ink flow path communicated with a discharge port of said recording head along said ink flow path each in different distance to the discharge port, and when a pre-discharge is performed without participating in recording, driving signals needed for discharging ink are supplied to the electrothermal converting element on a side near to the discharge port subsequent to being supplied to the electrothermal converting element on a side away from the discharge port.

2. An ink jet recording apparatus according to claim 1, wherein said pre-discharge is the pre-discharge performed immediately before recording per line, and a discharging number of the electrothermal converting element on the side away from the discharge port is more than that of the electrothermal converting element on the side near to the discharge port.

3. An ink jet recording apparatus according to claim 1, wherein said pre-discharge is the pre-discharge performed per a designated number of discharges, and a discharging number of the electrothermal converting element on the side away from the discharge port is more than that of the electrothermal converting element on the side near to the discharge port.

4. An ink jet recording apparatus according to claim 1, wherein said pre-discharge is the pre-discharge performed immediately after a suction recovery operation, and a discharging number of the electrothermal converting element on the side near to the discharge port is more than that of the electrothermal converting element on the side away from the discharge port.

5. An ink jet recording apparatus according to claim 1, wherein when recording is performed, driving signals for discharging ink are supplied only to the electrothermal converting element on the side near to the discharge port.

6. An ink jet recording apparatus according to claim 1, wherein said recording head is provided with an electrothermal converting element for generating thermal energy to be utilized for discharging ink.

7. An ink jet recording apparatus according to claim 6, wherein said recording head discharges ink utilizing film boiling generated in ink by thermal energy generated by said electrothermal converting element.

8. An ink jet recording head for recording on a recording medium by discharging ink from discharge port, wherein at least two electrothermal converting elements each having different amount of heat generation, and driven each individually, are arranged in an ink flow path communicated with a discharge port of said recording head along said ink flow path each in different distance to the discharge port, and when a pre-discharge is performed without participating in recording, driving signals needed for discharging ink are supplied to the electrothermal converting element on a side near to the discharge port subsequent to being supplied to the electrothermal converting element on a side away from the discharge port.

9. An ink jet recording head according to claim 8, wherein said pre-discharge is the pre-discharge performed immediately before recording per line, and a discharging number of the electrothermal converting element on the side away from the discharge port is more than that of the electrothermal converting element on the side near to the discharge port.

10. An ink jet recording head according to claim 8, wherein said pre-discharge is the pre-discharge performed per a designated number of discharges, and a discharging number of the electrothermal converting element on the side away from the discharge port is more than that of the electrothermal converting element on the side near to the discharge port.

11. An ink jet recording head according to claim 8, wherein said pre-discharge is the pre-discharge performed immediately after a suction recovery operation, and a discharging number of the electrothermal converting element on the side near to the discharge port is more than that of the electrothermal converting element on the side away from the discharge port.

12. An ink jet recording head according to claim 8, wherein when recording is performed, driving signals for discharging ink are supplied only to the electrothermal converting element on the side near to the discharge port.

13. An ink jet recording head according to claim 8, wherein said recording head is provided with an electrothermal converting element for generating thermal energy to be utilized for discharging ink.

14. An ink jet recording head according to claim 13, wherein said recording head discharges ink utilizing film boiling generated in ink by thermal energy generated by said electrothermal converting element.

15. An ink jet recording method for recording on a recording medium by discharging ink from a recording head, comprising the following steps of:

arranging at least two electrothermal converting elements each having different amount of heat generation, and driven each individually in an ink flow path communicated with a discharge port of said recording head along said ink flow path each in different distance to the discharge port; and supplying driving signals needed for discharging ink to the electrothermal converting element on a side near to the discharge port subsequent to being supplied to the electrothermal converting element on a side away from the discharge port when a pre-discharge is performed without participating in recording.

16. An ink jet recording method according to claim 15, wherein said pre-discharge is the pre-discharge performed immediately before recording per line, and a discharging number of the electrothermal converting element on the side away from the discharge port is more than that of the electrothermal converting element on the side near to the discharge port.

17. An ink jet recording method according to claim 15, wherein said pre-discharge is the pre-discharge performed per a designated number of discharges, and a discharging number of the electrothermal converting element on the side away from the discharge port is more than that of the electrothermal converting element on the side near to the discharge port.

18. An ink jet recording method according to claim 15, wherein said pre-discharge is the pre-discharge performed immediately after a suction recovery operation, and a discharging number of the electrothermal converting element on the side near to the discharge port is more than that of the electrothermal converting element on the side away from the discharge port.

19. An ink jet recording method according to claim 15, wherein when recording is performed, driving signals for discharging ink are supplied only to the electrothermal converting element on the side near to the discharge port.

* * * * *